US006755642B2

(12) United States Patent
Zhang

(10) Patent No.: US 6,755,642 B2
(45) Date of Patent: Jun. 29, 2004

(54) SAFETY PIEZOELECTRIC LIGHTER

(75) Inventor: Guo Quan Zhang, Shanghai (CN)

(73) Assignee: Hui Lin Chen, San Gabriel, CA (US)

( * ) Notice: Subject to any disclaimer, the term of this patent is extended or adjusted under 35 U.S.C. 154(b) by 0 days.

(21) Appl. No.: 10/135,075

(22) Filed: May 1, 2002

(65) Prior Publication Data

US 2002/0132201 A1 Sep. 19, 2002

Related U.S. Application Data

(63) Continuation-in-part of application No. 09/669,343, filed on Sep. 26, 2000.

(51) Int. Cl.[7] ..... F23Q 2/28
(52) U.S. Cl. ..... 431/153; 431/255; 431/132
(58) Field of Search ..... 431/153, 255, 431/132, 152, 129, 344, 146, 130, 150

(56) References Cited

U.S. PATENT DOCUMENTS 3,712,788 A * 1/1973 Solzer ..... 431/150
4,377,378 A * 3/1983 Low ..... 431/140
5,310,336 A * 5/1994 Segawa ..... 431/132
5,531,591 A * 7/1996 Yamazaki ..... 431/153
6,116,892 A * 9/2000 Yang ..... 431/153
6,135,761 A * 10/2000 Chen ..... 431/132
6,186,772 B1 * 2/2001 Huang ..... 431/132
6,431,853 B1 * 8/2002 Sher ..... 431/153
6,478,575 B2 * 11/2002 Sher ..... 431/153

FOREIGN PATENT DOCUMENTS

GB 2 247 308 A * 2/1992 ..... F23Q/2/30

* cited by examiner

*Primary Examiner*—Josiah Cocks
(74) *Attorney, Agent, or Firm*—Raymond Y. Chan; David and Raymond Patent Group

(57) ABSTRACT

A safety piezoelectric lighter incorporates with a safety arrangement which includes an ignition cap having a locker cavity. A locking unit includes a locking latch extended from an inner wall of the casing and a locker arm disposed in the locker cavity of the ignition cap. An operation button slidably mounted on the ignition cap for moving the locker arm to an unlocked position. A resilient element is arranged for applying an urging pressure against the locker arm so as to normally retain the locker arm in a locking position that the locker arm is biased against the locker latch so as to block up the ignition cap from being slid downward for ignition. A user must operate the operation button for moving the locker arm away from the locking latch, so that the ignition cap is capable of being slid downward to ignite the piezoelectric lighter.

12 Claims, 10 Drawing Sheets

SAFETY PIEZOELECTRIC LIGHTER

CROSS REFERENCE OF RELATED APPLICATION

This is a Continuation-In-Part application of a non-provisional application, application Ser. No. 09/669,343, filed Sep. 26, 2000.

BACKGROUND OF THE PRESENT INVENTION

1. Field of Invention

The present invention relates to a piezoelectric lighter, and more particularly to a safety piezoelectric which can lock up the ignition actuation of the ignition cap, so as to prevent the piezoelectric lighter from being ignited accidentally.

2. Description of Related Arts

Piezoelectric lighters, especially the slide-down type piezoelectric lighters, have been commonly known and used since the operation of such slide-down type piezoelectric lighters is simple that the user can easily slide the ignition button sidewardly and downwardly to ignite the piezoelectric lighter. So, nowadays, people are more concern about the aesthetic appearance of the lighter rather than the safety feature thereof. Because of the unprotected lighter, children may abuse the lighter, which may cause accidental fire that not only burn down out homes but also destroy our lives.

SUMMARY OF THE PRESENT INVENTION

A main object of the present invention is to provide a safety piezoelectric lighter which can not only stop under age children from the usage of the lighter but also prevent the lighter from being ignited accidentally.

Another object of the present invention is to provide a safety piezoelectric lighter incorporating with a safety arrangement which normally locks up the ignition cap to prevent the ignition of the lighter.

Another object of the present invention is to provide a safety piezoelectric lighter wherein a locking member of the safety arrangement must be manipulated and remained in an unlocked position in order to actuate the ignition cap for igniting the lighter. Therefore, children under five years old are unable to complete the ignition operation.

Another object of the present invention is to provide a safety piezoelectric lighter incorporating with the safety arrangement, which not only normally retains in a locked condition but also automatically return to a locked condition after each ignition so as to prevent any unintentional ignition of the lighter.

Another object of the present invention is to provide a safety piezoelectric lighter wherein the safety arrangement is adapted to be installed into any kind of piezoelectric lighter having an ignition cap. In other words, both slide-down type and push-down type of piezoelectric lighters are capable of incorporating with the safety arrangement of the present invention without altering their original structural designs.

Another object of the present invention is to provide a safety piezoelectric lighter which is incorporating with the safety arrangement without destroy the aesthetic appearance of the lighter.

Accordingly, in order to accomplish the above objects, the present invention provides a piezoelectric lighter, comprising:

a casing receiving a liquefied gas storage;

a gas emitting nozzle disposed in the casing and communicating with the liquefied gas storage for controlling a flow of gas;

a piezoelectric unit, which is disposed in the casing for generating piezoelectricity, comprising a movable operating part extended upwardly and an ignition tip extended to a position close to the gas emitting nozzle, wherein when the movable operating part is depressed downwardly, the ignition tip generates sparks to ignite to gas emitted from the gas emitting nozzle; and a safety arrangement, comprising:

an ignition cap which is slidably mounted on the casing and is attached to a top end of the piezoelectric unit in such a manner that when the ignition cap is pressed downwardly, the movable operating part of the piezoelectric unit is depressed to ignite the piezoelectric lighter;

a locking unit comprising a locking latch extended from an inner wall of the casing and a locker arm movably supported at a front portion of the ignition cap and arranged to engage with the locking latch for blocking up the ignition cap from being slid downwardly so as to lock up the ignition cap from ignition;

an operation button slidably mounted on top of the ignition cap for moving the locker arm to an unlocked position that the locker arm is disengaged with the locking latch, so that the ignition cap is capable of being slid downward to ignite the piezoelectric lighter; and a resilient element which is disposed between the locker arm and the ignition cap for applying an urging pressure against the locker arm so as to normally urge and retain the locker arm engaging with the locking latch so as to block up the ignition cap from being slid downward and prevent an ignition of the piezoelectric lighter.

In order to ignite the piezoelectric lighter, a user's thumb must intentionally move the operation button to a position that the locker arm is disengaged with the locking latch. Then, the user can slide the ignition cap downwardly while remaining the locker arm is such disengagement position to ignite the piezoelectric lighter. After every ignition operation, when the ignition cap returns to its original position, the resilient element will automatically rebound the locker arm to re-engage with the locking latch so as to lock up the ignition cap.

DETAILED DESCRIPTION OF THE PREFERRED EMBODIMENT

Figure 1:
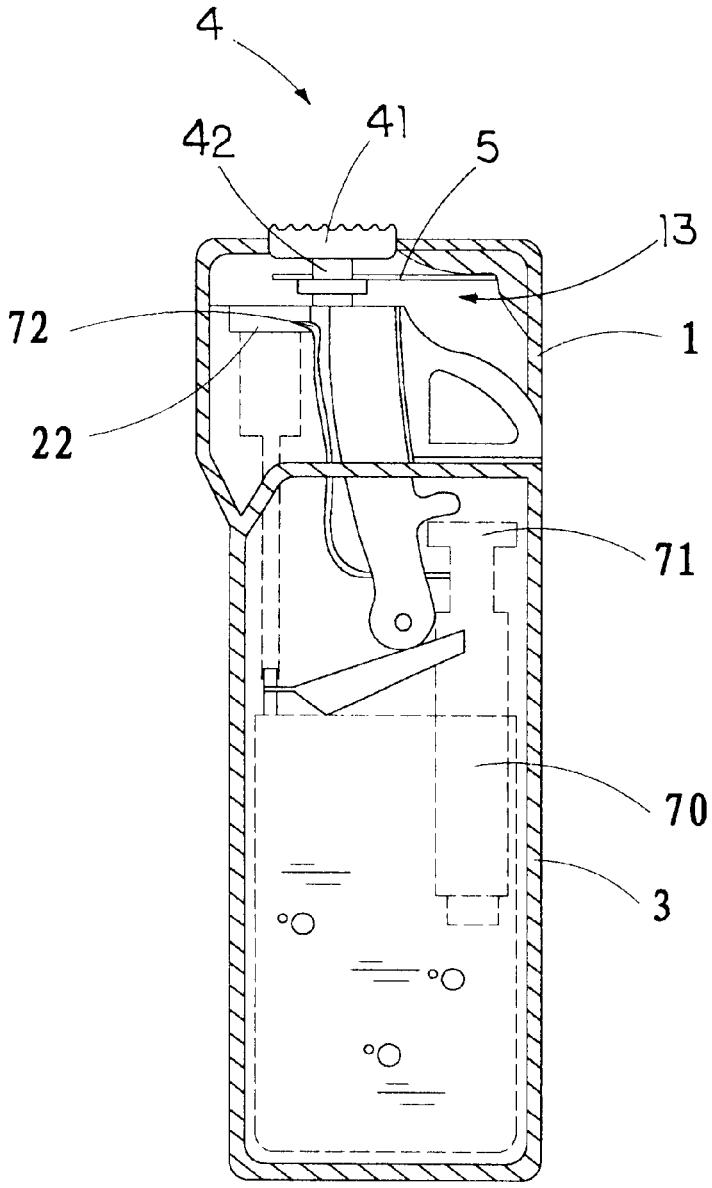
FIG. 1 is a sectional view of a safety piezoelectric lighter according to a first preferred embodiment of the present invention.

Referring to FIG. 1 of the drawings, a safety piezoelectric lighter according to a first preferred embodiment of the present invention comprises a casing 3 receiving a liquefied gas storage and a gas emitting nozzle 22 disposed in the casing 3 and communicating with the liquefied gas storage for controlling a flow of gas.

A piezoelectric unit 70, which is disposed in the casing 3 for generating piezoelectricity, comprises a movable operating part 71 extended upwardly and an ignition tip 72 extended to a position close to the gas emitting nozzle, wherein when the movable operating part 71 is depressed downwardly, the ignition tip 72 generates sparks to ignite to gas emitted from the gas emitting nozzle 22.

The safety piezoelectric lighter further comprises a safety arrangement which comprises an ignition cap 1, a locking unit 6, an operation button 4, and a resilient element 5.

The ignition cap 1 is slidably mounted on the casing 3 and is attached to a top end of the piezoelectric unit 70 in such a manner that when the ignition cap 1 is pressed downwardly, the movable operating part 71 of the piezoelectric unit 70 is depressed to ignite the piezoelectric lighter.

The locking unit 6 comprises a locking latch 61 extended from an inner wall of the casing 3 and a locker arm 51 movably supported at a front portion of the ignition cap 1 and arranged to engage with the locking latch 61 for blocking up the ignition cap 1 from being slid downwardly so as to lock up the ignition cap 1 from ignition.

Figure 4:
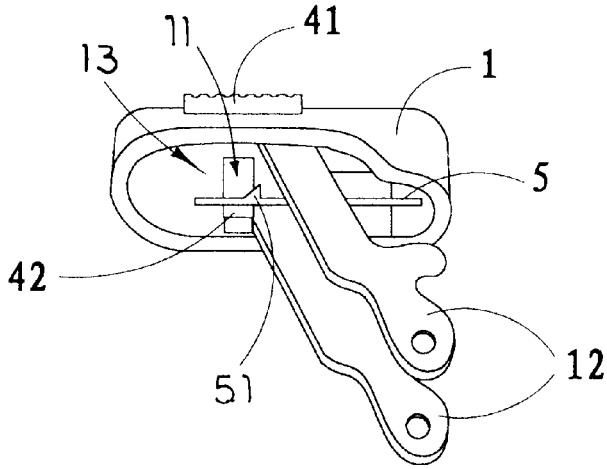
FIG. 4 is a bottom perspective view of the ignition cap of the safety piezoelectric lighter according to the above first preferred embodiment of the present invention.

As shown in FIG. 4, the operation button 4 is slidably mounted on top of the ignition cap 1 for moving the locker arm 51 to an unlocked position that the locker arm 51 is disengaged with the locking latch 61, so that the ignition cap 1 is capable of being slid downward to ignite the piezoelectric lighter.

The resilient element 5 is disposed between the locker arm 51 and the ignition cap 1 for applying an urging pressure against the locker arm 51 so as to normally urge and retain the locker arm 51 engaging with the locking latch 61 so as to block up the ignition cap 1 from being slid downward and prevent an ignition of the piezoelectric lighter.

According to the preferred embodiment, the casing 3 further comprises a supporting frame 2 having a curve-shaped rear supporting wall 21 wherein the gas emitting nozzle 22 is upwardly extended from the casing 3 to a ceiling 23 of the supporting frame 2 at a front portion thereof.

The ignition cap 1 is slidably mounted on the casing 3 in a radially movable manner wherein the ignition cap 1 comprises a depressing arm 12 downwardly extended through the supporting frame 2 to rest on top of the piezoelectric unit 70 in such a manner that when the ignition cap 1 is depressed sidewardly and downwardly at the same time, the depressing arm 12 will be driven downwardly to depress the piezoelectric unit 70 to ignite the piezoelectric lighter. Moreover, the ignition cap 1 has a locker cavity 13 provided therein and a guiding slot 11 provided on at top wall of the ignition cap 1 to communicate the locker cavity 13 with outside.

Figure 2:
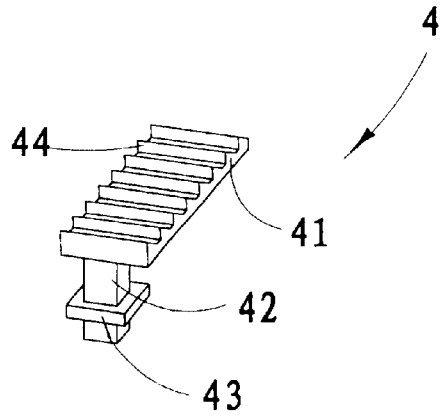
FIG. 2 is a perspective view of an operation button of the safety piezoelectric lighter according to the above first preferred embodiment of the present invention.
Figure 5:
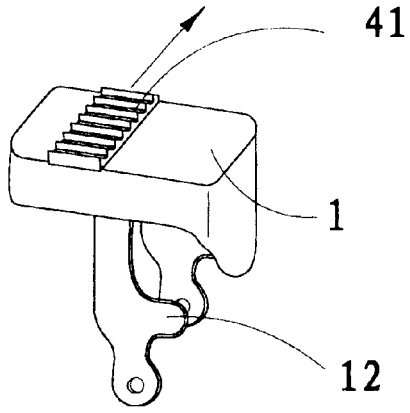
FIG. 5 is a top perspective view of the ignition cap of the safety piezoelectric lighter according to the above first preferred embodiment of the present invention.

As shown in FIGS. 2 and 5, the operation button 4, having a generally T-shaped, comprises a slider body 41 slidably mounted on the top wall of the ignition cap 1 and a driving arm 42 downwardly extended from the slider body 41 to the locker cavity 13 of the ignition cap 1 through the guiding slot 11 wherein driving arm 42 is arranged to be driven by the slider body 41 to move locker arm 51 disengaging from the locking latch 61, so as to unlock the sliding movement of the ignition cap 1.

Accordingly, the guiding slot 11 is an elongated slot transversely provided on the top wall of the ignition cap 1 such that the slider body 41 of the operation button 4 slidably mounted on the ignition cap 1 in a sidewardly movable manner to move the locker arm 51 away from the locking latch 61 to unlock the ignition cap 1.

The operation button 4 further comprises a locating member 43 affixed to a bottom end portion of the driving arm 42 in the locker cavity 13 of the ignition cap 1 so as to ensure the operation button 4 is securely slid on the ignition cap 1 along the guiding slot 11. In other words, the operation button 4 is substantially mounted on the top wall of the ignition cap 1 in a slidably movable manner to unlock the ignition cap 1 from the locking position.

The operation button 4 further has a plurality of indented grooves 44 spacedly formed on the slider body 41 so as to increase the friction between the user's thumb and the slider body 41. So, the user can easily manipulate the operation button 4 in order to unlock the piezoelectric lighter.

Figure 3:
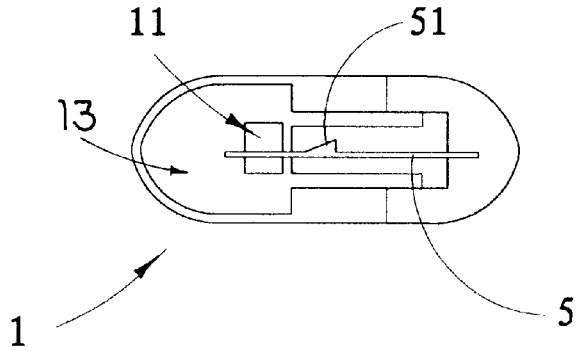
FIG. 3 is a sectional view of an ignition cap of the safety piezoelectric lighter according to the above first preferred embodiment of the present invention.

As shown in FIGS. 3 and 4, the resilient element 5, according to the preferred embodiment, has an elongated body, such as an elastic metal blade, longitudinally disposed in the locker cavity 13 of the ignition cap 1. The resilient element 5 has a front end suspendedly biasing against the bottom portion of the driving arm 42 and a rear end affixed to an inner wall of the ignition cap 1, wherein the resilient element 5 is adapted for applying an urging pressure against the driving arm 42 so as to normally retain the operation button 4 in the locked position. Accordingly, the driving arm 42 is adapted for forcing the resilient element 5 to be bent sidewardly that the locking arm 51 is disengaged with the locking latch 61 so as to unlock the sliding movement of the ignition cap 1.

Figure 6:
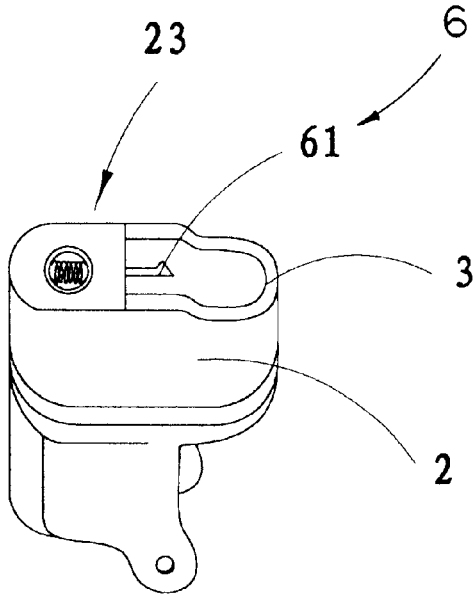
FIG. 6 is a partial perspective view of a casing of the safety piezoelectric lighter according to the above first preferred embodiment of the present invention.

As shown in FIG. 6, the locking latch 61 of the locking unit 6 is affixed to the inner wall of the casing 3 and extended toward to a position close to the front end of the resilient element 5.

Figure 7A:
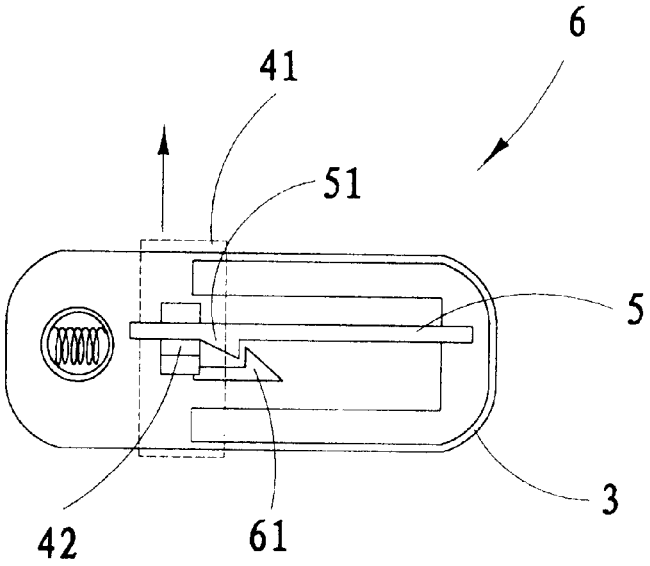
FIG. 7A illustrates the safety piezoelectric lighter in an unlocked position according to the above first preferred embodiment of the present invention.
Figure 7B:
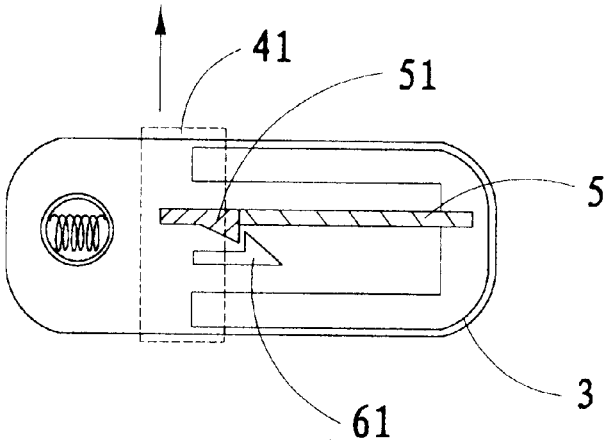
FIG. 7B illustrates an alternative mode of the locker arm of the safety piezoelectric lighter according to the above first embodiment of the present invention.

Referring to FIG. 7A, the locker arm 51 is extended to the front end of the resilient element 5 and arranged to normally engage with the locking latch 61 for blocking up the sideward movement of the ignition cap 1, so as to lock up the ignition cap 1 from ignition. In other words, at the locked position as shown in FIG. 7A, the locker arm 51 is engaged with the locking latch 61 for locking up the ignition cap 1 from being slid sidewardly so as to locking up the ignition cap 1 from ignition, and at the unlocked position, the locker arm 51 is disengaged with the locking latch 61 so as to release the locking up of the ignition cap 1 so that the ignition cap 1 is capable of being slid sidewardly to ignite the piezoelectric lighter. Accordingly, the locker arm 51 is integrally extended from the front end of the resilient element 5 wherein the locker arm 51 is sidewardly protruded from the resilient element 5 to normally engage with the locking latch 61, as shown in FIG. 7A. Alternatively, the locker arm 51 is adapted to be securely attached to the front end of the resilient element 5 to engage with the locking latch 61, as shown in FIG. 7B.

According to the preferred embodiment, the locking latch 61 has a locking tip having a tapered shaped suspendedly provided at a free end thereof, and the locking arm 51 has a corresponding engaging tip having a tapered shaped arranged to securely engage with the locking tip of the locking latch 61, so as to securely lock up the ignition cap 1 from ignition.

In order to ignite the piezoelectric lighter, a user's thumb must intentionally apply a sideward force to push the slider body 41 sidewardly in order to bend the resilient element 5 sidewardly by the driving arm 42. At the mean time, the locker arm 51 is driven to disengage with the locking latch 61, so as to unlock the ignition cap 1. Then, the user can slide the ignition cap 1 downwardly to compress the piezoelectric unit 70 while remaining the locker arm 51 is such disengagement position to ignite the piezoelectric lighter.

While the ignition cap 1 is slid back to its original position, i.e. after every ignition operation, the resilient element 5 will automatically rebound to regain its original form wherein the locker arm 51 is moved to re-engage with the locking latch 61 so as to lock up the ignition cap 1.

Figure 8:
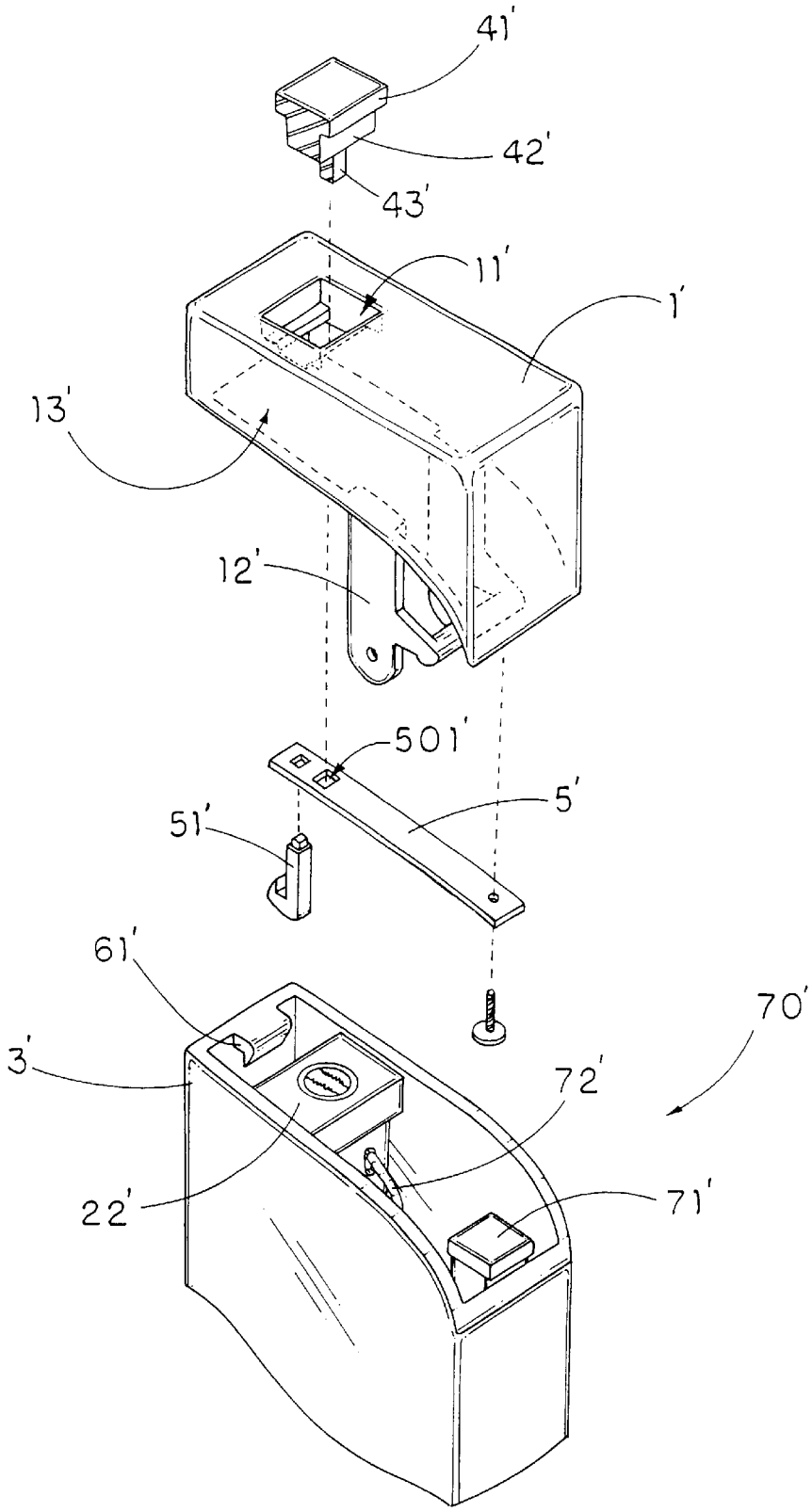
FIG. 8 is a partially exploded perspective view of the safety piezoelectric lighter according to a second preferred embodiment of the present invention.

Referring to FIG. 8, a second embodiment of the safety piezoelectric lighter illustrates an alternative mode of the first embodiment, wherein the safety piezoelectric lighter of the second embodiment, comprises a casing 3' receiving a liquefied gas storage and a gas emitting nozzle 22' disposed in the casing 3' and communicating with the liquefied gas storage for controlling a flow of gas.

A piezoelectric unit 70', which is disposed in the casing for generating piezoelectric, comprises a movable operating part 71' extended upwardly and an ignition tip 72' extended to a position close to the gas emitting nozzle, wherein when the movable operating part 71' is depressed downwardly, the ignition tip 72' generates sparks to ignite to gas emitted from the gas emitting nozzle 22'.

The ignition cap 1' is slidably mounted on the casing 3' in a rotationally movable manner wherein the ignition cap 1' comprises a depressing arm 12' downwardly extended through the supporting frame 2' to rest on top of the piezoelectric unit 70' in such a manner that when the ignition cap 1' is depressed sidewardly and downwardly at the same time, the depressing arm 12' will be driven downwardly to depress the piezoelectric unit 70' to ignite the piezoelectric lighter. Moreover, the ignition cap 1' has a locker cavity 13' provided therein and a guiding slot 11' provided on at top wall of the ignition cap 1' to communicate the locker cavity 13' thereof with outside.

The operation button 4', having a generally T-shaped, comprises a slider body 41' mounted on the top wall of the ignition cap 1' in a vertically movable manner and a driving arm 42' downwardly extended from the slider body 41' to the locker cavity 13' of the ignition cap 1' through the guiding slot 11'.

The resilient element 5', according to the second embodiment, is an elastic metal blade longitudinal disposed in the locker cavity 13' of the ignition cap 1. The resilient element 5' has a rear end affixed to an inner wall of the ignition cap 1' and a front end suspendedly extended to bias against a bottom portion of the driving arm 42' for applying an urging pressure against the operation button 4', so as to retain the operation button 4' in an upper position which is the normally locking position of the safety arrangement. The resilient element 5' is adapted for being bent downwardly when the operation button 4' is pressed downwardly.

In order to securely attach the operation button 4' to the resilient element 5', the resilient element 5' has a through hole 501' provided at the front end thereof, wherein the operation button 4' has a locking protrusion 43' downwardly extended from the bottom portion of the driving arm 42' and arranged to slidably pass through the through hole 501' so as to lock up the operation button 4' at the front end of the resilient element 5'.

The locking latch 61' of the locking unit 6' is provided at the inner wall of the casing 3 and extended towards to a position close to the front end of the resilient element 5. Accordingly, the locking latch 61' is integrally extended from a front edge of the casing 3' towards the locker cavity 13' of the ignition cap 1'. Alternatively, the locking latch 61' is adapted to be firmly affixed to the front portion of the inner wall of the casing 3' in order to function as a stopper to block up the rotational movement of the ignition cap 1'.

Figure 9A:
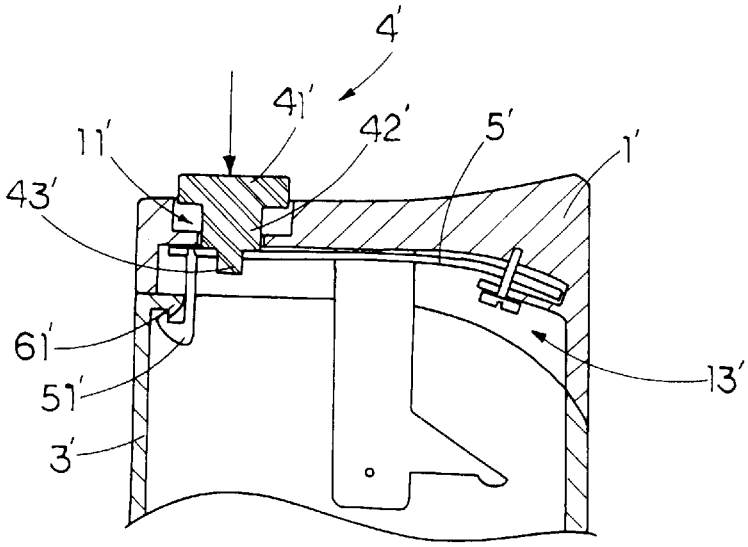
FIGS. 9A and 9B illustrate an unlocked operation of the safety piezoelectric lighter according to the above second preferred embodiment of the present invention.

The locker arm 51' is extended from the front end of the resilient element 5' wherein the resilient element 5' also applies an urging force against the locker arm 51' to push it upwardly to a position that the locker arm 51' is normally engaged with the locking latch 61' for blocking up the sideward movement of the ignition cap 1', so as to lock up the ignition cap 1' from ignition, as shown in FIG. 9A.

As shown in FIG. 8, the locker arm 51' has a hook shape downwardly extended from the front end of the resilient element 5' and the locking latch 61' has a catch-like shape longitudinally extended from the inner wall of the casing 3' for fittedly engaging with the locker arm 51', so as to securely lock up the ignition cap 1' from ignition.

Figure 9B:
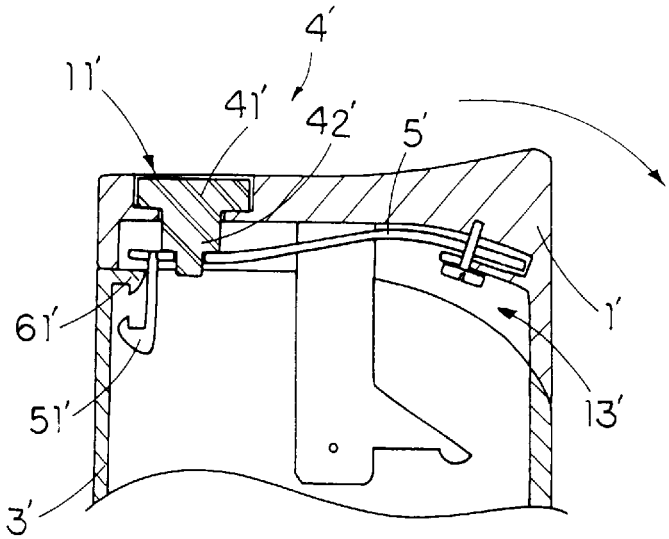

In order to ignite the piezoelectric lighter, the user must unlock the safety arrangement and operate the ignition cap 1' at the same time. As shown in FIG. 10B, the user must apply a downward force on the slider body 41' in order to press the front end of the resilient arm 5' downwardly by the driving arm 42', so that the locker arm 51' is forced to move downwardly until the locker arm 51' is disengaged with the locking latch 61', i.e. the unlocked position of the safety arrangement, as shown in FIG. 9B. Then, the ignition cap 1' is free to be depressed downwardly and sidewardly to depress the movable operating part 71' of the piezoelectric unit 70' to ignite the piezoelectric lighter.

After the piezoelectric lighter is ignited, the user may release the depressing of the ignition cap 1' so that the compressed piezoelectric unit 70' will rebound to its original form which pushes the ignition cap 1' back to its original locking position. Furthermore, the resilient element will rebound to regain its original form which forces the locker arm 51' to re-engage with the locking latch 61' so as to lock up the ignition cap 1'.

Figure 10:
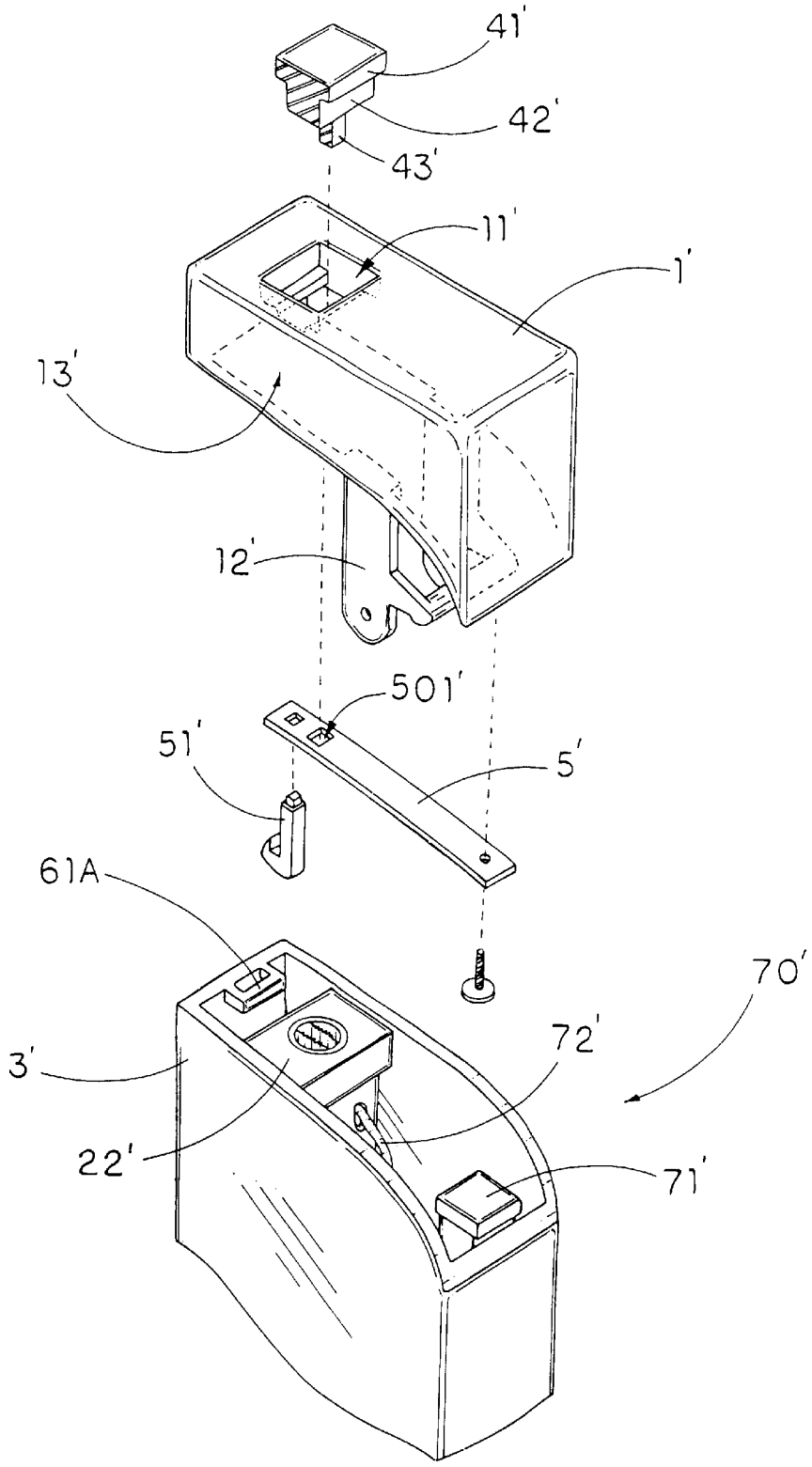
FIG. 10 illustrates an alternative mode of the locking latch of the safety piezoelectric lighter according to the above second preferred embodiment of the present invention.

FIG. 10 illustrates an alternative mode of the locking latch 61A which is embodied to have a ring shape affixed to the inner wall of the casing 3' wherein the locker arm 51', having a hook shaped, is arranged to engage with the locking latch 61A by hooking the locker arm 51' on the locking latch 61A.

Figure 11:
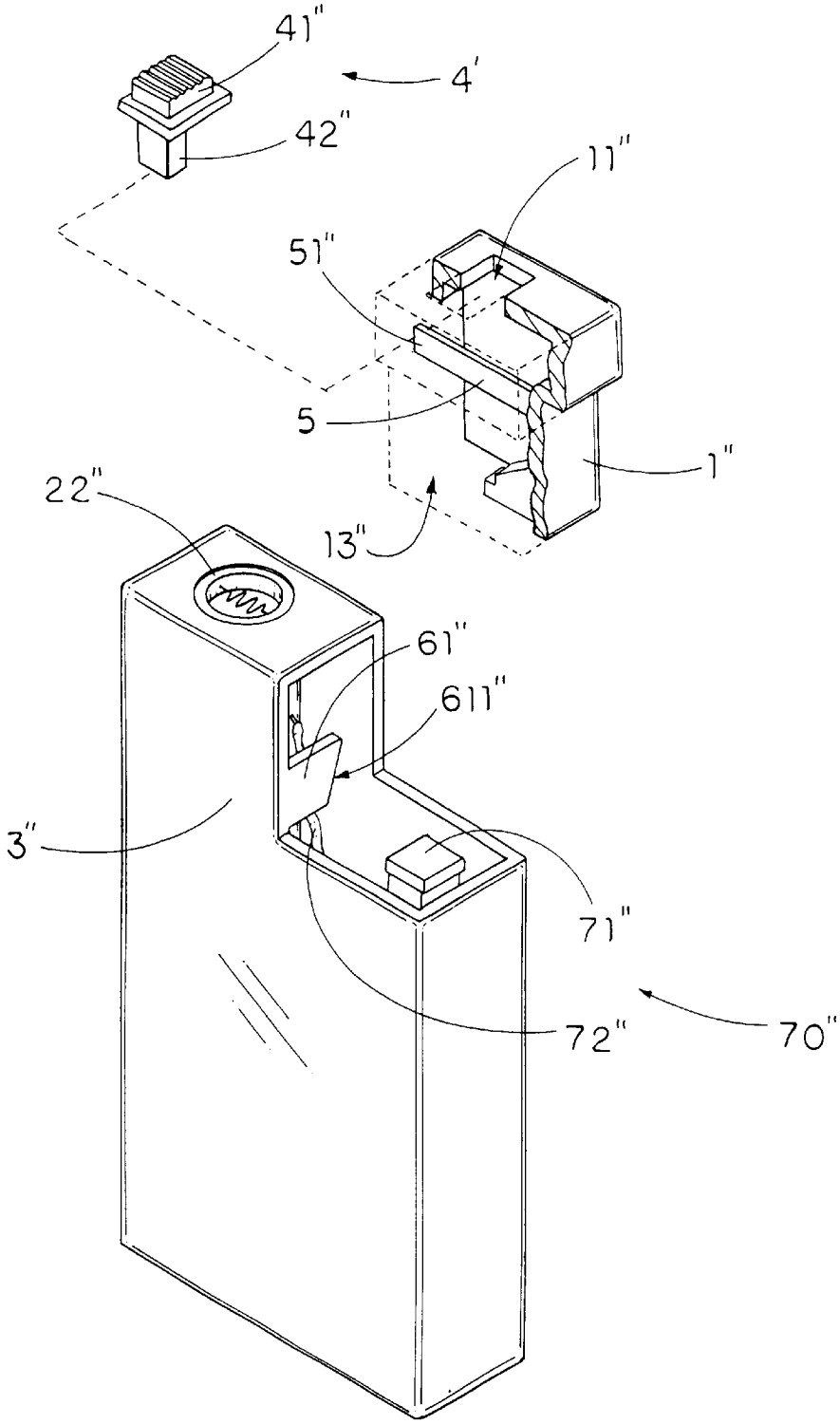
FIG. 11 illustrates a safety piezoelectric lighter according to a third preferred embodiment of the present invention, illustrating the ignition cap being slidably mounted on the casing in a vertically movable manner.

Referring to FIG. 11, a safety piezoelectric lighter according to a third embodiment illustrates an alternative mode of the first embodiment, wherein the ignition cap 1" is slidably mounted on the casing 3" in a vertically movable manner. The ignition cap 1" is rested on top of the piezoelectric unit 70" in such a manner that when the ignition cap 1" is depressed downwardly, the movable operating part 71" of the piezoelectric unit 70" is compressed to ignite the piezoelectric lighter.

The operation button 4" comprises a slider body 41" slidably mounted on the top wall of the ignition cap 1" in a sidewardly movable manner and a driving arm 42" downwardly extended from the slider body 41" to the locker cavity 13" of the ignition cap 1" through the guiding slot 11".

The resilient element 5" has a rear end affixed to an inner wall of the ignition cap 1" and a front end suspendedly extended to bias against a bottom portion of the driving arm 42" for applying an urging pressure against the operation button 4", so as to retain the operation button 4" in the locking position, wherein the operation button 4" is arranged to force the front end of the resilient element 5" to bend sidewardly to move the locker arm 51" in the unlocked position.

Accordingly, the guiding slot 11" is an elongated slot transversely provided on the top wall of the ignition cap 1" in such a manner that the slider body 41" is adapted for sidewardly sliding on said ignition cap 1" for bending the resilient element 5" sidewardly by the driving arm 42" so as to move the locker arm 51" away from the locking latch 61".

The locking latch 61" is transversely extended from the inner wall of the casing that facing the ignition cap 1" to the locker cavity 13" of the ignition cap 1" and the front end of the resilient element 5" is extended toward the locking latch 61" to form the locker arm 51" wherein the resilient element 5" applies an urging against the locker arm 51" to pushes it sidewardly to a position that the locker arm 51" is normally engaged with the locking latch 61" for blocking up the downward movement of the ignition cap 1", so as to lock up the ignition cap 1" from ignition. Furthermore, the locking latch 61" has a tapered shape to provide a slanted sliding surface 611" extended downwardly.

Figure 12A:
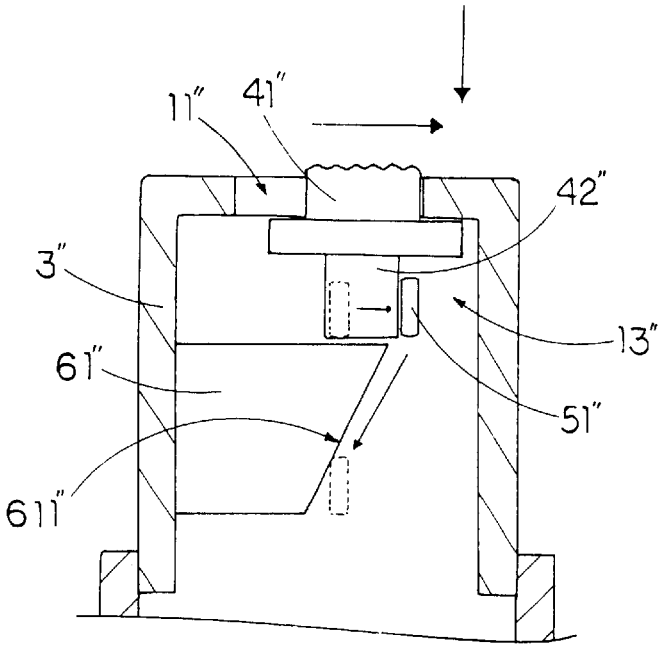
FIG. 12A illustrates the safety piezoelectric lighter in a locking position according to the above third preferred embodiment of the present invention.

To ignite the piezoelectric lighter, the user must push a sideward force on the slider body 41" in order to push the front end of the resilient arm 5" bending sidewardly through the driving arm 42", in such a manner that the locker arm 51" is forced to move sidewardly unit the locker arm 51" is disengaged with the locking latch 61", as shown in FIG. 12A. Then the ignition cap 1" is free to depress downwardly to ignite the piezoelectric lighter.

Figure 12B:
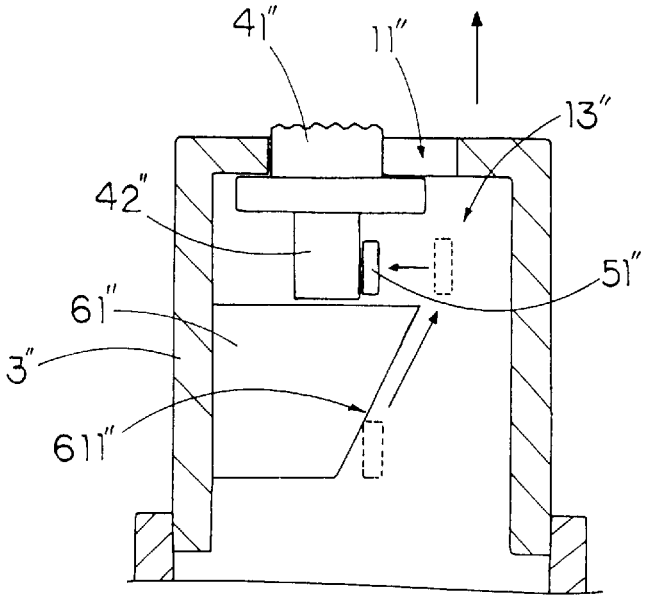
FIG. 12B illustrates the safety piezoelectric lighter in an unlocked position according to the above third preferred embodiment of the present invention.

After the piezoelectric lighter is ignited, the ignition cap 1" is returned to its original position that the locker arm 51" is slid on the slanted sliding surface 611" of the locking latch 61" back to re-engage with the locking latch 61" so as to lock up the ignition cap 1" after every ignition, as shown in FIG. 12B. In other words, the slanted sliding surface 611" of the locking latch 61" is adapted for ensuring the locker arm 51" sliding back to an original locking position thereof, wherein when the ignition cap 1" is depressed downwardly, the locker arm 51" is moved into the casing 3" as well. Moreover, when the ignition cap 1" is rebounded upwardly to an original locking position thereof after ignition, the slanted sliding surface 611", which urges against the locker arm 51" and the resilient element 5", guides the locker arm 51" sliding back to a top of the locking latch 61", so as to re-lock up the ignition cap 1" from ignition.

Figure 13:
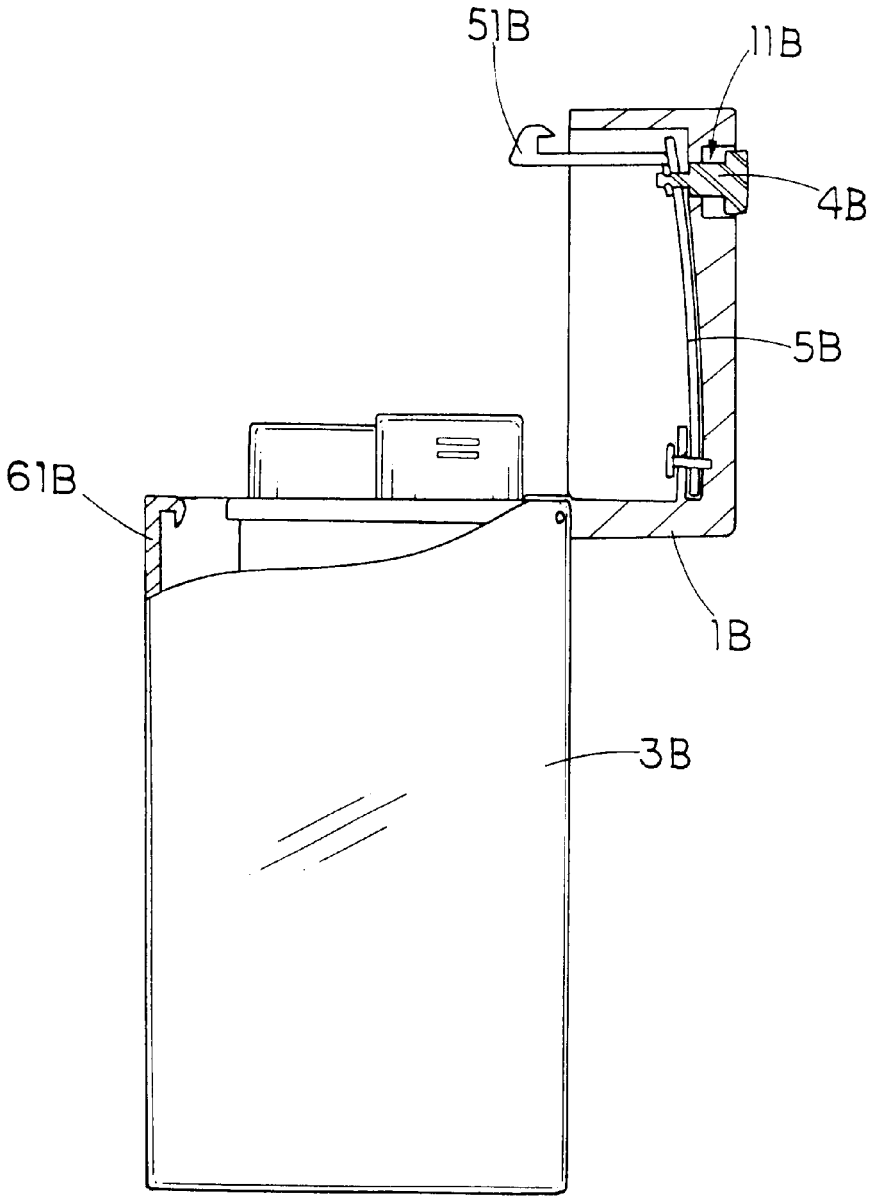
FIG. 13 illustrates an alternative of the safety arrangement of the safety piezoelectric lighter according to the above second preferred embodiment of the present invention, illustrating the safety arrangement incorporating with a lighter cap.

FIG. 13 illustrates the safety arrangement is adapted to be installed into a lighter cap 1B of the piezoelectric lighter wherein the lighter cap 1B is pivotally mounted on top of the casing 3B.

As shown in FIG. 13, the lighter cap 1B, which functions as the ignition cap 1' of the second embodiment, is slidably mounted on the casing 1B wherein the guiding slot 11B is provided on the top wall of the lighter cap 1B.

The operation button 4B is slidably mounted on top of the lighter cap 1B in a vertically movable manner. The resilient element 5B has a rear end affixed to an inner wall of the lighter cap 1B and a front end extended to bias against a bottom portion of the driving arm 42B of the operation button 4B.

The locking latch 61B of the locking unit 6B is provided at the inner wall of the casing 3B and extended towards to a position close to the front end of the resilient element 5B. The locker arm 51B is extended from the front end of the resilient element 5B such that the resilient element 5B applies an urging force against the locker arm 51B to push it upwardly to a position that the locker arm 51B is normally engaged with the locking latch 61B for locking up the lighter cap 1B. Therefore, the user must unlock the safety arrangement in order to open the lighter cap 1B. Once the lighter cap 1B is opened, the user is able to operate the ignition cap for ignition.

What is claimed is:

1. A safety piezoelectric lighter, comprising:

a casing receiving a liquefied gas storage;

a gas emitting nozzle disposed in a front portion of said casing and communicating with said liquefied gas storage for controlling a flow of gas;

a piezoelectric unit disposed in said casing for generating piezoelectricity; and a safety arrangement, comprising:

a lighter cap, which is slidably mounted on said casing in a rotationally movable manner, having a locker cavity provided therein and a guiding slot provided on a front end of a top wall of said lighter cap for communicating said locker cavity with outside;

an operation button comprising a slider body slidably mounted on a top wall of said lighter cap in a vertically movable manner and a driving arm downwardly extended from said slider body to said locker cavity through said guiding slot;

a resilient element which is an elastic blade longitudinal disposed in said locker cavity of said lighter cap, wherein said resilient element has a rear end affixed to said lighter cap and a front end suspendedly extended to bias against a bottom portion of said driving arm to apply an urging pressure against said operation button; and a locking unit, which is arranged adjacent to said gas emitting nozzle, comprising a locking latch and a locker arm which is extended from said front end of said resilient element which normally urges and retains said locker arm in a locking position, wherein said locking latch is provided at a front portion of an inner wall of said casing and extends from a top edge of said front portion of said inner wall to a position close to said front end of said resilient element and towards said locker cavity of said lighter cap, wherein said resilient element applies an urging force against said locker arm to push said locker arm upwardly to a position that said locker arm is normally engaged with said locking latch to block up said lighter cap from being slid downward, wherein when a downwardly force is apply to depress said operation button to an unlocked position, said front end of said resilient arm is pressed downwardly by said driving arm and said locker arm is moved downwardly away from said locking latch until said locker arm is disengaged with said locking latch, and then said lighter cap is capable of being slid downward to ignite said piezoelectric lighter, wherein when said downwardly force is released, said resilient element rebounds to an original position thereof to force said locking arm to re-engage with said locking latch so as to lock up said lighter cap.

2. The safety piezoelectric lighter, as recited in claim 1, wherein said locker arm has a hook shape downwardly extended from said front end of said resilient element and said locking latch has a locking tip, having a tapered shape, suspendedly extended from said front inner wall of said casing for securely engaging with said locker arm so as to securely lock up said lighter cap.

3. The safety piezoelectric lighter, as recited in claim 1, wherein said locking latch has a ring shape affixed to said front inner wall of said casing and said locker arm has a hook shape downwardly extended from said front end of said resilient element to engage with said locker latch to securely lock up said lighter cap.

4. The safety piezoelectric lighter, as recited in claim 1, wherein said lighter cap is an ignition cap slidably mounted on said casing in a radially movable manner, said ignition cap being attached to a top end of said piezoelectric unit and arranged in such a manner that when said ignition cap is depressed sidewardly and downwardly at the same time, said piezoelectric unit is depressed to ignition said piezoelectric lighter.

5. The safety piezoelectric lighter, as recited in claim 2, wherein said lighter cap is an ignition cap slidably mounted on said casing in a radially movable manner, said ignition cap being attached to a top end of said piezoelectric unit and arranged in such a manner that when said ignition cap is depressed sidewardly and downwardly at the same time, said piezoelectric unit is depressed to ignition said piezoelectric lighter.

6. The safety piezoelectric lighter, as recited in claim 3, wherein said lighter cap is an ignition cap slidably mounted on said casing in a radially movable manner, said ignition cap being attached to a top end of said piezoelectric unit and arranged in such a manner that when said ignition cap is depressed sidewardly and downwardly at the same time, said piezoelectric unit is depressed to ignition said piezoelectric lighter.

7. The safety piezoelectric lighter, as recited in claim 1, wherein said resilient element has a through hole provided at said front end, wherein said operation button has a locking protrusion downwardly extended from said bottom portion of said driving arm to slidably pas through said through hole so as to lock up said operation button at said front end of said resilient element.

8. The safety piezoelectric lighter, as recited in claim 2, wherein said resilient element has a through hole provided at said front end, wherein said operation button has a locking protrusion downwardly extended from said bottom portion of said driving arm to slidably pas through said through hole so as to lock up said operation button at said front end of said resilient element.

9. The safety piezoelectric lighter, as recited in claim 3, wherein said resilient element has a through hole provided at said front end, wherein said operation button has a locking protrusion downwardly extended from said bottom portion of said driving arm to slidably pas through said through hole so as to lock up said operation button at said front end of said resilient element.

10. The safety piezoelectric lighter, as recited in claim 4, wherein said resilient element has a through hole provided at said front end, wherein said operation button has a locking protrusion downwardly extended from said bottom portion of said driving arm to slidably pas through said through hole so as to lock up said operation button at said front end of said resilient element.

11. The safety piezoelectric lighter, as recited in claim 5, wherein said resilient element has a through hole provided at said front end, wherein said operation button has a locking protrusion downwardly extended from said bottom portion of said driving arm to slidably pas through said through hole so as to lock up said operation button at said front end of said resilient element.

12. The safety piezoelectric lighter, as recited in claim 6, wherein said resilient element has a through hole provided at said front end, wherein said operation button has a locking protrusion downwardly extended from said bottom portion of said driving arm to slidably pas through said through hole so as to lock up said operation button at said front end of said resilient element.

* * * * *